US008782831B2

(12) United States Patent
Houston et al.

(10) Patent No.: US 8,782,831 B2
(45) Date of Patent: Jul. 22, 2014

(54) BABY SWADDLE

(71) Applicants: Robert Houston, Oak Park, IL (US); Anna Jones, Oak Park, IL (US)

(72) Inventors: Robert Houston, Oak Park, IL (US); Anna Jones, Oak Park, IL (US)

(73) Assignee: Anna & Eve LLC, Placitas, NM (US)

( * ) Notice: Subject to any disclaimer, the term of this patent is extended or adjusted under 35 U.S.C. 154(b) by 0 days.

(21) Appl. No.: 13/872,062

(22) Filed: Apr. 26, 2013

(65) Prior Publication Data

US 2013/0283527 A1 Oct. 31, 2013

Related U.S. Application Data

(60) Provisional application No. 61/639,839, filed on Apr. 27, 2012.

(51) Int. Cl.

| | |
|---|---|
| ***A47G 9/02*** | (2006.01) |
| ***A47C 31/10*** | (2006.01) |
| ***B68G 5/00*** | (2006.01) |

(52) U.S. Cl.
USPC ..... 5/494; 5/482; 5/655

(58) Field of Classification Search
USPC ..... 5/494, 482, 655; 2/69.5, 80, 83
See application file for complete search history.

(56) References Cited

U.S. PATENT DOCUMENTS

| | | | | | |
|---|---|---|---|---|---|
| 2,643,398 | A * | 6/1953 | Routman | 5/494 |
| 2,989,753 | A * | 6/1961 | Burner | 2/69.5 |
| 3,779,540 | A * | 12/1973 | Boudreau | 5/655 |
| 4,125,903 | A * | 11/1978 | Farrell | 2/69.5 |
| 4,172,300 | A * | 10/1979 | Miller | 5/424 |
| 4,597,121 | A * | 7/1986 | Bouma | 5/494 |
| 4,688,282 | A * | 8/1987 | Jeffries | 5/413 R |
| 4,833,730 | A * | 5/1989 | Nelson | 2/44 |
| 4,897,885 | A * | 2/1990 | Lunt | 2/69.5 |
| 5,129,406 | A * | 7/1992 | Magnusen et al. | 128/873 |
| 5,484,395 | A * | 1/1996 | DeRoche | 602/19 |
| 5,551,109 | A * | 9/1996 | Tingley et al. | 5/655 |
| 6,662,390 | B1 * | 12/2003 | Berger | 5/486 |
| 6,755,799 | B2 * | 6/2004 | Toda | 602/19 |
| 6,928,674 | B2 * | 8/2005 | Blackburn | 5/482 |
| 7,181,789 | B2 * | 2/2007 | Gatten | 5/494 |
| 7,254,849 | B1 * | 8/2007 | Fiebrich et al. | 5/482 |
| 7,774,875 | B1 * | 8/2010 | Zeidman | 5/494 |
| 8,191,188 | B2 * | 6/2012 | Kaplan et al. | 5/485 |
| D690,426 | S * | 9/2013 | Houston et al. | D24/190 |
| 2004/0216230 | A1 * | 11/2004 | Blackburn | 5/482 |
| 2005/0150047 | A1 * | 7/2005 | Trani et al. | 5/482 |
| 2006/0150330 | A1 * | 7/2006 | Gatten | 5/494 |
| 2007/0056098 | A1 * | 3/2007 | Schmid et al. | 5/482 |
| 2007/0157392 | A1 * | 7/2007 | Ragen | 5/655 |
| 2010/0275373 | A1 * | 11/2010 | Kaplan et al. | 5/494 |
| 2010/0299801 | A1 * | 12/2010 | Nilsson | 2/69.5 |
| 2010/0319133 | A1 * | 12/2010 | Whitlock et al. | 5/655 |
| 2011/0078855 | A1 * | 4/2011 | Buckson | 5/494 |
| 2012/0311762 | A1 * | 12/2012 | Aiken et al. | 2/69.5 |

* cited by examiner

*Primary Examiner* — William Kelleher
*Assistant Examiner* — Eric Kurilla
(74) *Attorney, Agent, or Firm* — Richards Patent Law P.C.

(57) ABSTRACT

The present disclosure provides a baby swaddle that includes an inner strap adapted to releasably connect around a baby's chest, an outer strap adapted to releasably connect around the inner strap and secure a baby's arms between the inner strap and outer strap, wherein the inner strap is configured to prevent the baby swaddle from moving toward a baby's head.

20 Claims, 4 Drawing Sheets

BABY SWADDLE

CROSS-REFERENCE TO RELATED APPLICATIONS

This application incorporates by reference and claims priority to U.S. Provisional Application No. 61/639,839 filed on Apr. 27, 2012.

BACKGROUND OF THE INVENTION

The present subject matter relates generally to an apparatus used to secure the arms of babies by their sides.

Swaddling is an age-old practice of wrapping a baby such that the baby's arms are tightly secured along the baby's body. Swaddling inhibits a baby's arms from their natural, involuntarily and uncontrolled movement that tends to prevent a baby from falling asleep, as well as tends to startle a baby from sleep. In addition, the pressure created from a secured swaddle around a baby's chest is believed to further calm the baby, which results in less crying and longer periods of uninterrupted sleep. It is thought that the tight bind of a baby's arms during the first three months of life simulates the conditions the baby experienced in the womb, thereby inducing a calming effect. Swaddling is also useful in keeping a baby sleeping on its back, which is important as recent medical science has indicated that babies sleeping on their backs are much less likely to experience sudden infant death syndrome (SIDS) than in other positions.

Swaddling is usually achieved by wrapping a baby in a large receiving blanket. The baby is usually placed in a receiving blanket and a series of folds are used to bind the baby's arms to the baby's sides. The folds also secure the blanket to itself such that the swaddle will not become undone. The result is a tightly cocooned baby in a blanket from head to toe.

However, current swaddling blankets and techniques pose safety risks to babies. For example, a suffocation risk is created when a baby's arms are not properly secured and the swaddle blanket moves upwards towards the baby's face. Typical swaddling blanket are not strong or secure enough to hold a baby's arms in place and prevent the blanket from moving upwards towards a baby's face when a baby wiggles.

Further, current swaddling blankets and techniques are often time consuming and cumbersome. Because babies are typically squirming during the swaddling process, parents often become frustrated with current swaddling blankets that require a complex pattern of multiple folds to secure the blanket around the baby. Often, a parent is trying to hold the baby still with one hand while the other hand is attempting to perform the series of folds. By the time a parent comes to the second or third fold, the first fold may have already been released due to the baby's own movement.

In addition, with typical swaddling blankets and techniques, in order to change a baby's diaper, the swaddle must be completely removed in order to access the diaper area. The commotion of swaddling, removing the swaddling for the diaper change, and then subsequently re-swaddling tends to aggravate babies, resulting in crying and further hindering them from falling asleep.

Current swaddle blankets may also cause a baby to overheat due to the amount of fabric needed to wrap around the baby, as well as the heaviness of the fabric. This is especially problematic during the summer months, but a legitimate risk year round.

Swaddling blankets may also be associated with improper muscle development of the hips and legs owing to the lower body restriction of movement while swaddled. Further, swaddling blankets that constrict the movement of the legs and hips of a baby contribute to or lead to hip dysplasia. Doctors often recommend discontinuing swaddling to avoid this risk.

In addition, typical swaddling blankets are only suitable for infants. Larger, stronger, and older babies cannot be swaddled with the current swaddling blankets and techniques because they are too large and too strong for the swaddle blanket to securely swaddle them.

Accordingly, there is a need for a baby swaddle that addresses the concerns and problems expressed above, as described and claimed herein.

BRIEF SUMMARY OF THE INVENTION

The baby swaddle disclosed herein provides a simple, less cumbersome, and safer baby swaddle than those currently available. The baby swaddle includes an inner strap that secures around a baby's chest and an outer strap that secures a baby's arms between the inner strap and outer strap. Because a parent only has the inner strap and outer strap to connect, the baby swaddle makes it particularly easy to swaddle a baby, despite any wiggling or squirming from the baby. In addition, the baby swaddle does not pose a suffocation risk because when the inner strap is secure around a baby's chest and the baby's arms are between the inner strap and outer strap, the baby's armpits block any upward movement of the inner strap. Because the inner strap is connected to the outer strap, the entire baby swaddle is prevented from any upward movement that would pose a risk to the baby.

In an embodiment, the baby swaddle includes an inner strap including at least two inner operative ends enabled to releasably connect to each other and an outer strap including at least two outer operative ends enabled to releasably connect to each other. In addition, the inner strap and outer strap are connected to each other. Alternatively, or in addition to, the outer strap may be enabled to releasably connect to an outer surface of the inner strap. In an example, the inner operative ends and outer operative ends connect by way of a hook and loop fastening system.

In another embodiment, the baby swaddle includes a first divider and a second divider, which are positioned between the inner strap and outer strap, and when the inner operative ends are connected and the outer operative ends are connected, a first arm receiving space and a second arm receiving space are created. For example, the first arm receiving space may be enclosed by an inner surface of the outer strap, an outer surface of the inner strap, and the first divider. The second arm receiving space may be enclosed by an inner surface of the outer strap, an outer surface of the inner strap, and the second divider. The first divider and second divider may be attached to an outer surface of the inner strap or an inner surface of the outer strap.

In another embodiment, the baby swaddle includes an inner strap adapted to releasably connect around a baby's chest and an outer strap adapted to releasably connect around the inner strap, wherein the inner strap and outer strap are connected to each other. The outer strap may be adapted to secure a baby's arms between the inner strap and outer strap. Further, the inner strap may be configured to prevent the baby swaddle from moving toward a baby's head.

The outer strap may include a first edge and a second edge, in which, when swaddling a baby, the first edge is substantially aligned between a baby's upper arms and shoulders, and the second edge is substantially aligned between a baby's lower arms and hips.

The baby swaddle may further include a first divider and a second divider, in which the first divider and second divider are positioned between the inner strap and outer strap. When the two inner operative ends are engaged and the two outer operative ends are engaged, the first divider and second divider are enabled to restrict movement of a baby's arms. Further, the first divider may extend substantially from the first edge of the outer strap to the second edge of the outer strap, and the second divider may extend substantially from the first edge of the outer strap to the second edge of the outer strap.

An advantage of the present invention is that it provides a baby swaddle that is easy to put on and take off a baby because the baby swaddle may only include two connections for the user to make in order to swaddle the baby.

A further advantage of the baby swaddle is that it does not present any suffocation risk to the baby owing to the inner strap preventing any upward movement of the baby swaddle towards a baby's face.

Another advantage of the baby swaddle is that a baby's diaper may be changed without having to remove the baby swaddle from the baby.

A further advantage of the baby swaddle is that it does not cause any overheating risk to a baby because the present baby swaddle does not cover the baby from head to toe.

In addition, the present baby swaddle does not cause any risk of improper muscle development or hip dysplasia because the baby swaddle does not bind the legs of the baby. Instead, the baby swaddle only swaddles the baby's arms, leaving the hips and legs free, which promotes proper muscle development in the legs and prevents hip dysplasia.

Another advantage of the baby swaddle is preventing infants who have skin conditions, such as eczema, from scratching themselves and further irritating their skin.

Yet another advantage of the baby swaddle is that it allows larger, stronger, or older babies to be swaddled based on the design.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
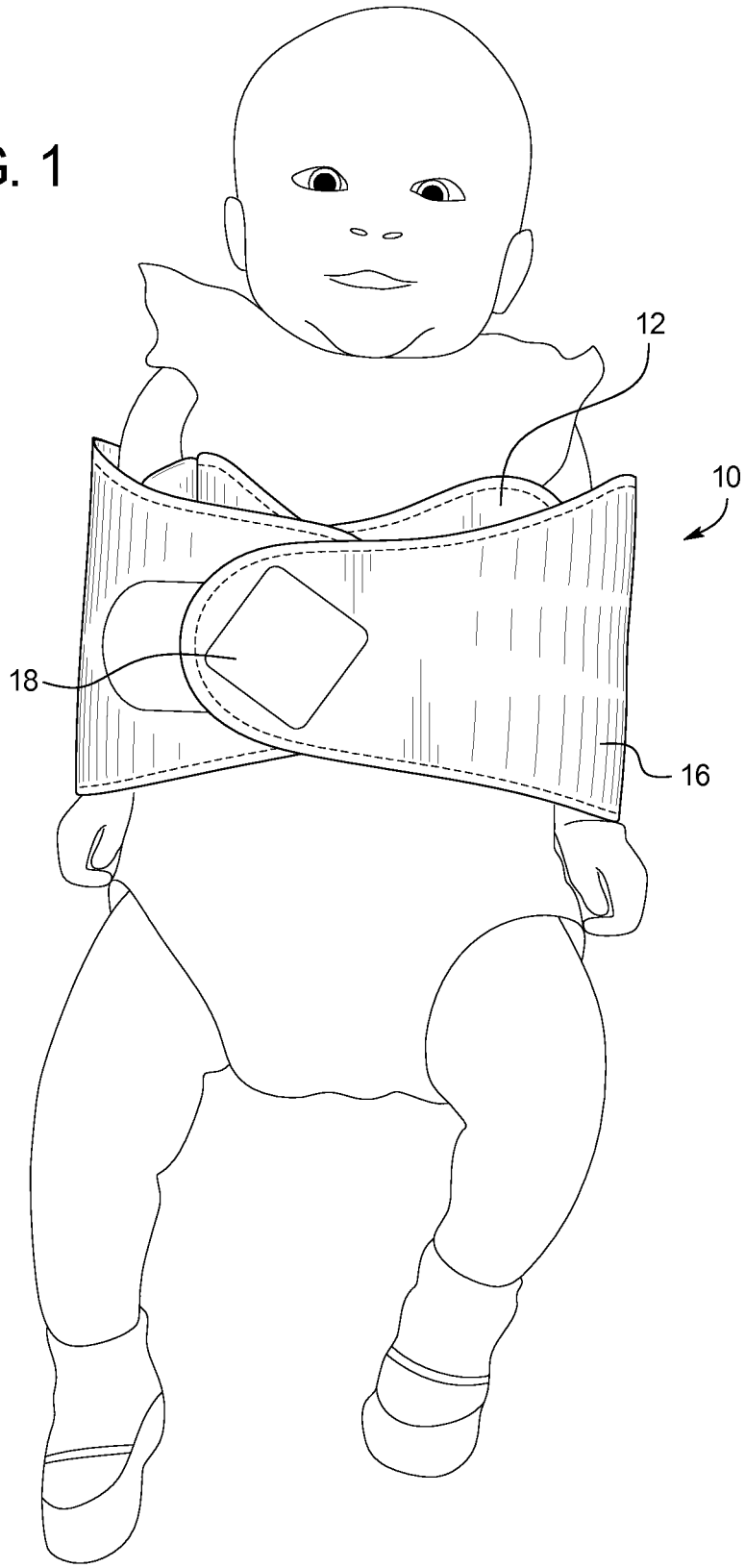
FIG. 1 is a front view of a baby in an embodiment of the baby swaddle, in which both the inner and outer straps are releasably connected.
Figure 2:
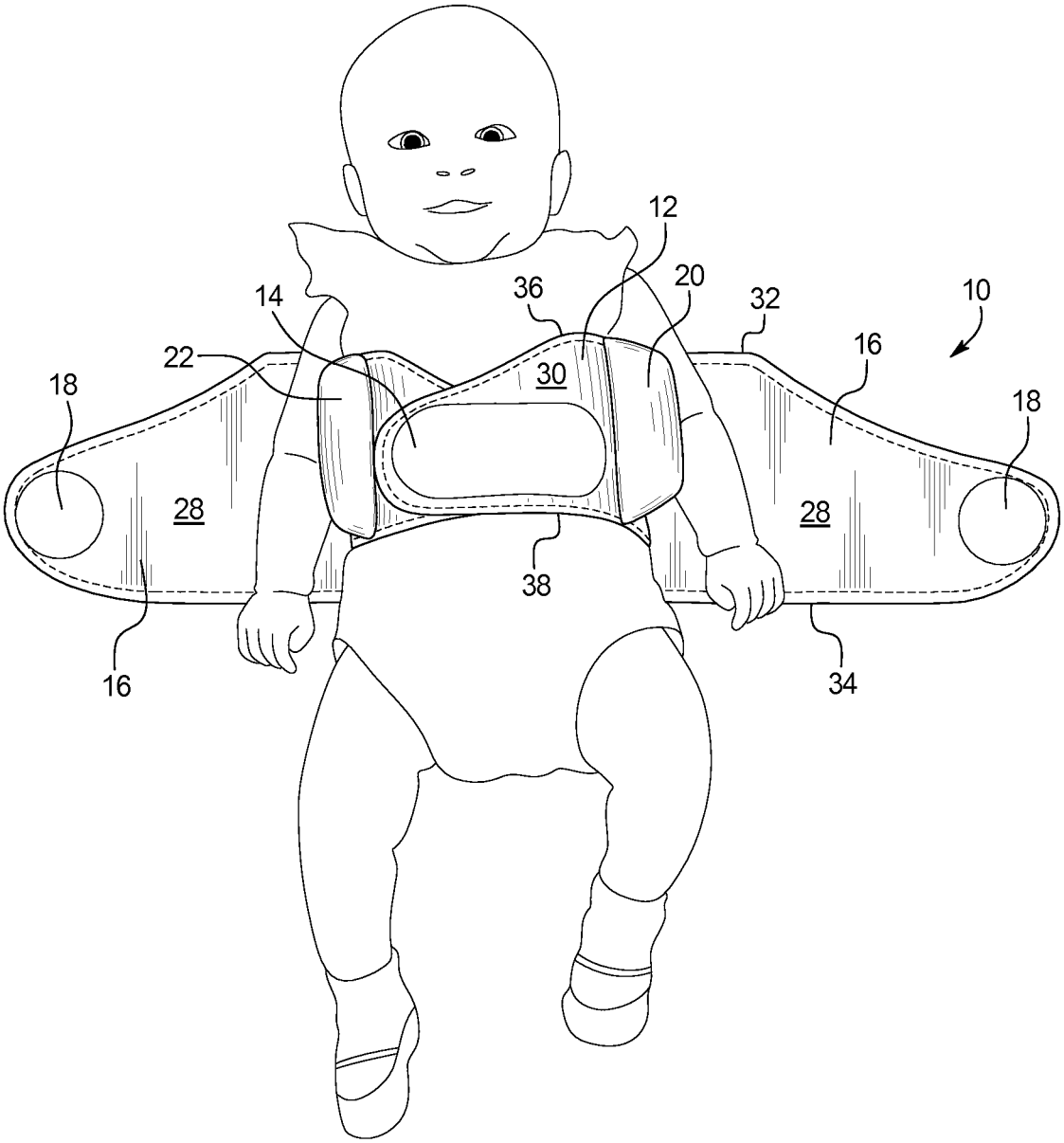
FIG. 2 is a front view of a baby in an embodiment of the baby swaddle, in which only the inner strap is releasably connected.

FIGS. 1 and 2 show embodiments of the disclosed baby swaddle 10 secured around a baby. As shown, the baby swaddle 10 includes an inner strap 12 adapted to releasably connect around a baby's chest. The baby swaddle 10 also includes an outer strap 16 adapted to releasably connect around the inner strap 12 and secure a baby's arms between the inner strap 12 and outer strap 16. In addition, the inner strap 12 is configured to prevent the baby swaddle 10 from moving toward a baby's head.

In order to secure the baby swaddle 10 to a baby, only two connections need to be made: the inner strap 12 must be releasably connected, as shown in FIG. 2, and the outer strap 16 must be releasably connected, as shown in FIG. 1. Therefore, securing the baby swaddle 10 to a baby an easy, stress-free endeavor. However, notwithstanding its minimalist approach, the baby swaddle 10 provides an advantageous swaddle device that secures a baby's arms, provides a tight fit around a baby's chest to induce calmness, while at the same time prevents any suffocation threat, and allows access to the diaper area.

Figure 3:
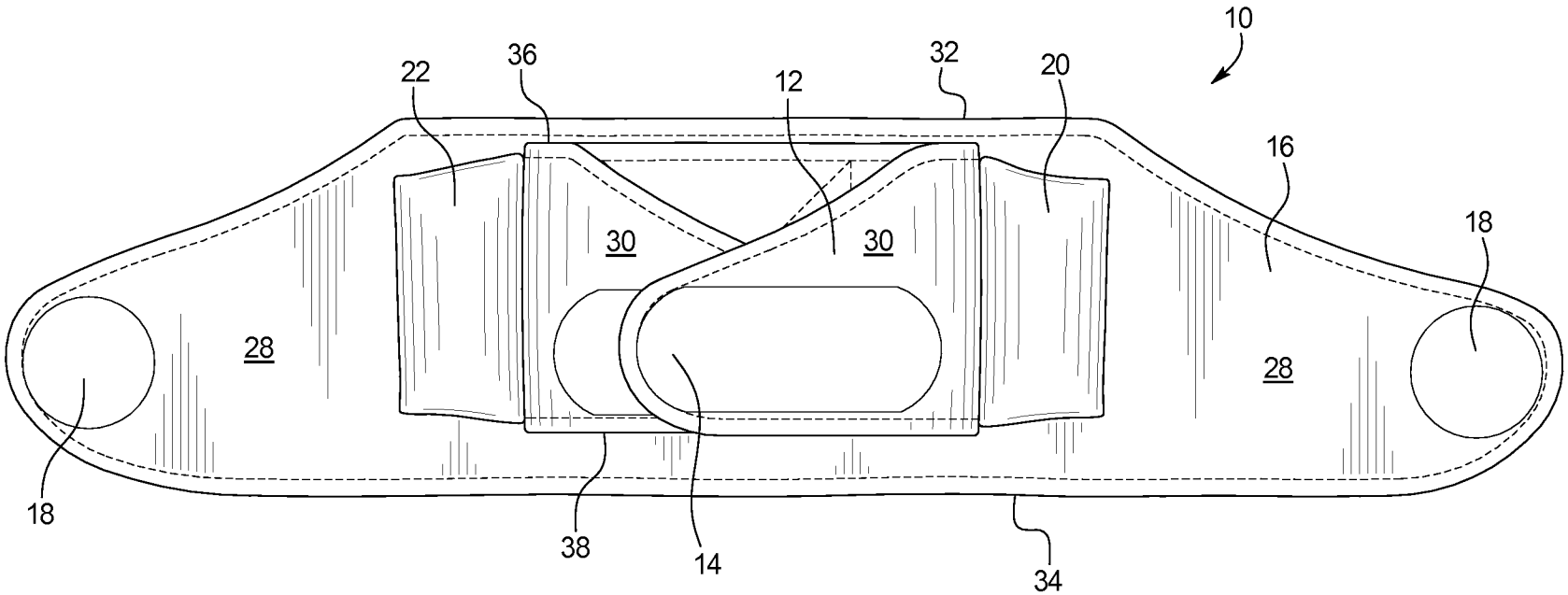
FIG. 3 is a front view of an embodiment of the baby swaddle, in which only the inner strap is releasably connected.

In an example shown in FIG. 3, the inner strap 12 includes at least two inner operative ends 14 enabled to releasably connect to each other and the outer strap 16 includes at least two outer operative ends 18 enabled to releasably connect to each other. The inner operative ends 14 and outer operative ends 18 may be independently connected by any suitable fastening mechanism. For example, the inner operative ends 14 and outer operative ends 18 may be independently releasably connected by snaps, buttons, zippers, hook and loop fastening systems, such as Velcro™, among others, and combinations thereof. For example, the inner operative ends 14 may be connected by a hook and loop fastening system and the outer operative ends 18 may be connected by a zipper.

Particularly preferable is the use of a hook and loop fastening system for the inner operative ends 14 and the outer operative ends 18. For example, the hook and loop fastening system may span the area of the inner strap 12 that is positioned on a baby's belly, as shown in FIG. 2, such that the releasable connection of the inner strap 12 is adjustable to allow for a connection around various size babies and at different tightness levels.

In addition, the inner strap 12 and outer strap 16 are connected to each other. Preferably, the inner strap 12 and outer strap 16 are sewn to each other. For example, the inner strap 12 and outer strap 16 may be sewn together in an area of the baby swaddle 10 that is positioned against the baby's back. Because the inner strap 12 and outer strap 16 are connected to each other, in combination with a baby's arms positioned between the inner strap 12 and outer strap 16, the baby swaddle 10 is not a suffocation hazard. A baby's arms blocks any upward movement of the baby swaddle 10 when the inner strap inner strap 12 is releasably connected around a baby's chest and the outer strap 16 is releasably connected around the inner strap 12, such that a baby's arms are between the inner strap 12 and outer strap 16.

Alternatively, or in addition, the outer strap 16 may be enabled to releasably connect to an outer surface 30 of the inner strap 12. For example, the outer operative ends 18 may releasably connect to the outer surface 30 of the inner strap 12. The outer operative ends 18 may, alternatively or in addition to, releasably connect to the inner surface 28 of the outer strap 16.

The baby swaddle 10 may be sized to fit various sizes of babies. As shown in FIGS. 2 and 3, the outer strap 16 may include a first edge 32 and a second edge 34, in which, when secured to a baby, the first edge 32 is substantially aligned between a baby's upper arms and shoulders, and the second edge 34 is substantially aligned between a baby's lower arms and hips. In another example, the inner strap 12 may include a first edge 36 and a second edge 38, in which, when secured to a baby, the first edge 36 is substantially aligned between a baby's upper arms and shoulders, and the second edge 38 is substantially aligned between a baby's lower arms and hips. Because the edges are aligned to only cover a baby's upper torso, a baby's diaper area may be accessed without having to remove the baby swaddle 10. Further, because the baby's legs are not restricted, there is no risk of improper muscle development in the lower body. Lastly, because the baby swaddle 10 is generally isolated to a baby's upper body, there is no threat of the baby overheating due to the baby swaddle 10.

Figure 4:
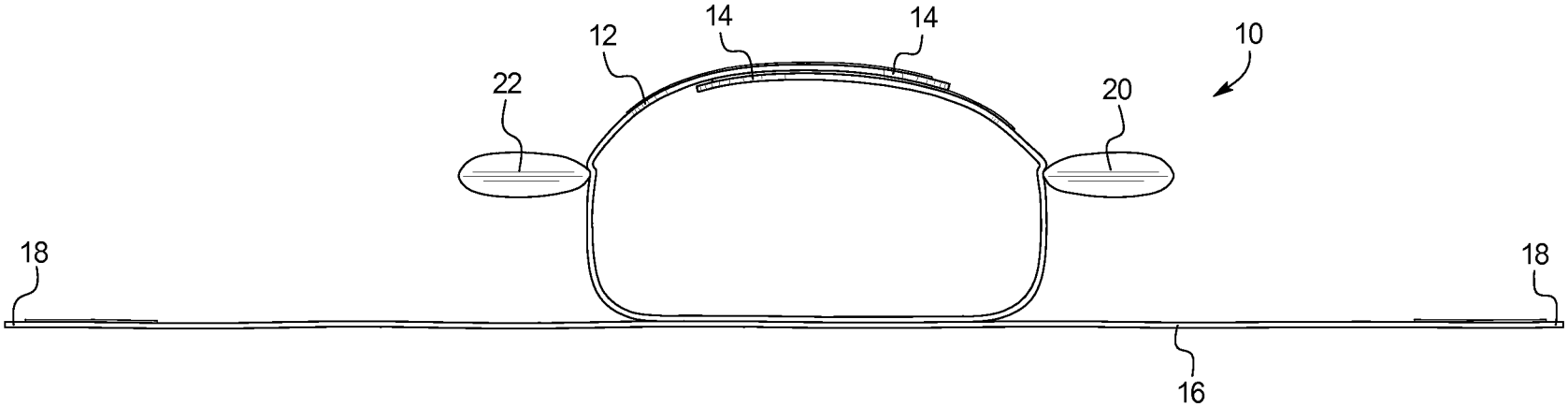
FIG. 4 is a bottom view of an embodiment of the baby swaddle, in which only the inner strap is releasably connected.

As shown in FIG. 3, the baby swaddle 10 may also include a first divider 20 and a second divider 22 that are positioned between the inner strap 12 and outer strap 16. When the inner operative ends 14 are releasably connected and the outer operative ends 18 are releasably connected, the first divider 20 and second divider 22 are enabled to restrict movement of a baby's arms. While the first divider 20 and second divider 22 may be attached to an outer surface 30 of the inner strap 12 or an inner surface 28 of the outer strap 16, FIG. 4 shows an example of the baby swaddle 10 in which the first divider 20 and second divider 22 are attached to the outer surface 30 of the inner strap 12.

Figure 5:
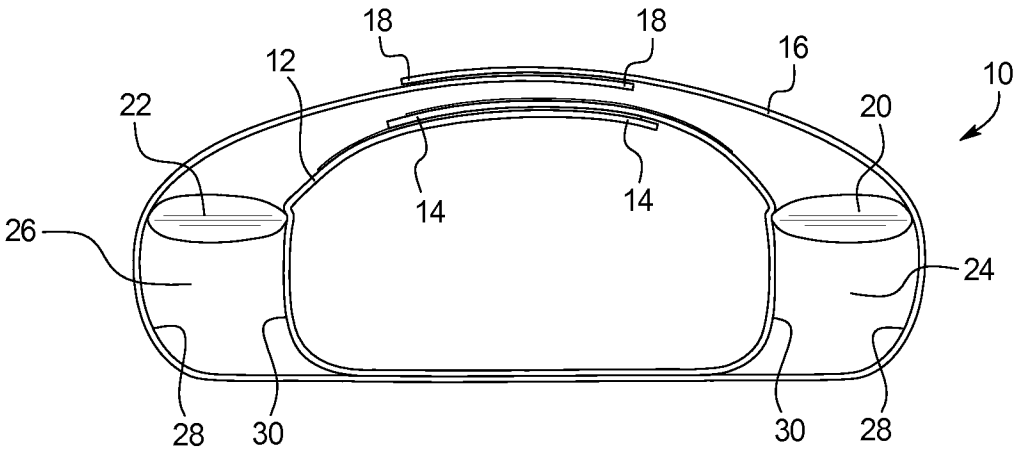
FIG. 5 is a bottom view of an embodiment of the baby swaddle, in which both the inner strap and outer strap are releasably connected.

As shown in FIG. 5, when the inner operative ends 14 are engaged and the outer operative ends 18 are engaged, a first arm receiving space 24 and a second arm receiving space 26 are created. For example, the first arm receiving space 24 are defined by an inner surface 28 of the outer strap 16, an outer surface 30 of the inner strap 12, and the first divider 20. The second arm receiving space 26 may be defined by an inner surface 28 of the outer strap 16, an outer surface 30 of the inner strap 12, and the second divider 22.

In an embodiment, the first divider 20 and second divider 22 extend from the first edge 36 of the inner strap 12 to the second edge 38 of the inner strap 12. In another example, the first divider 20 and second divider 22 extend substantially from the first edge 32 of the outer strap 16 to the second edge 34 of the outer strap 16. The dividers 20 and 22 function to secure a baby's arms within the first receiving space 24 and second receiving space 26.

It should be noted that various changes and modifications to the embodiments described herein will be apparent to those skilled in the art. Such changes and modifications may be made without departing from the spirit and scope of the present invention and without diminishing its attendant advantages. For example, various embodiments of the device may be provided based on various combinations of the features and functions from the subject matter provided herein.

We claim:

1. A baby swaddle comprising: an inner strap including at least two inner operative ends enabled to releasably connect to each other; an outer strap including at least two outer operative ends enabled to releasably connect to each other; and a first divider and a second divider, wherein the first divider and the second divider are cushioned pillows, wherein the first divider and second divider are positioned between the inner strap and outer strap, wherein the first divider and second divider are attached to an outer surface of the inner strap or to an inner surface of the outer strap, wherein a first arm receiving space is created from an inner surface of the outer strap, an outer surface of the inner strap, and the first divider, and wherein a second arm receiving space is created from an inner surface of the outer strap, an outer surface of the inner strap, and the second divider, wherein the inner strap and outer strap are connected to each other.

2. The baby swaddle of claim 1 wherein, when the inner operative ends are releasably connected and the outer operative ends are releasably connected, the first arm receiving space and the second arm receiving space are created.

3. The baby swaddle of claim 2 wherein the outer strap includes a first edge and a second edge, wherein the first edge is substantially aligned between a baby's upper arms and shoulders, and wherein the second edge is substantially aligned between a baby's lower arms and hips.

4. The baby swaddle of claim 2 wherein the first divider and second divider are attached to an outer surface of the inner strap.

5. The baby swaddle of claim 1 wherein the outer strap is enabled to releasably connect to an outer surface of the inner strap.

6. The baby swaddle of claim 1 wherein the inner operative ends and outer operative ends include a hook and loop fastening system.

7. The baby swaddle of claim 1, wherein an edge extending the length of the first divider is connected to the outer surface of the inner strap, and wherein an edge extending the length of the second divider is connected to the outer surface of the inner strap.

8. The baby swaddle of claim 7 wherein the first divider and second divider are rectangular cushioned pillows or trapezoidal cushioned pillows.

9. A baby swaddle comprising: an inner strap adapted to releasably connect around a baby's chest; and an outer strap adapted to releasably connect around the inner strap; and a first divider and a second divider, wherein the first divider and the second divider are cushioned pillows, wherein the first divider and second divider are positioned between the inner strap and outer strap, wherein the first divider and second divider are attached to an outer surface of the inner strap or to an inner surface of the outer strap, wherein the outer strap is adapted to secure a baby's arms between the inner strap and outer strap, wherein a first arm receiving space is created from an inner surface of the outer strap, an outer surface of the inner strap, and the first divider, and wherein a second arm receiving space is created from an inner surface of the outer strap, an outer surface of the inner strap, and the second divider, wherein the inner strap and outer strap are connected to each other.

10. The baby swaddle of claim 9 wherein the inner strap is configured to prevent the baby swaddle from moving toward a baby's head.

11. The baby swaddle of claim 9 wherein the outer strap includes a first edge and a second edge, wherein the first edge is substantially aligned between a baby's upper arms and shoulders, and wherein the second edge is substantially aligned between a baby's lower arms and hips.

12. The baby swaddle of claim 9 wherein the first divider and second divider are attached to an outer surface of the inner strap.

13. The baby swaddle of claim 9 wherein the outer strap comprises a first outer edge and second outer edge, wherein the first divider extends substantially from the first outer edge to the second outer edge, and wherein the second divider extends substantially from the first outer edge to the second outer edge.

14. The baby swaddle of claim 9 wherein the inner strap comprises a first inner edge and second inner edge, wherein the first divider extends substantially from the first inner edge to the second inner edge, and wherein the second divider extends substantially from the first inner edge to the second inner edge.

15. The baby swaddle of claim 9, wherein an edge extending the length of the first divider is connected to the outer surface of the inner strap, and wherein an edge extending the length of the second divider is connected to the outer surface of the inner strap.

16. The baby swaddle of claim 15 wherein the first divider and second divider are rectangular cushioned pillows or trapezoidal cushioned pillows.

17. A baby swaddle consisting essentially of: an inner strap adapted to releasably connect around a baby's chest; an outer strap adapted to releasably connect around the inner strap; and a first divider and a second divider, wherein the first divider and the second divider are cushioned pillows, wherein the first divider and second divider are positioned between the inner strap and outer strap, wherein the first divider and second divider are attached to an outer surface of the inner strap or to an inner surface of the outer strap, wherein the outer strap is adapted to secure a baby's arms between the inner strap and outer strap, wherein the inner strap and outer strap are connected to each other, wherein the outer strap includes a first edge and a second edge, wherein the first edge is substantially aligned between a baby's upper arms and shoulders, and wherein the second edge is substantially aligned between a baby's lower arms and hips.

18. The baby swaddle of claim 17 wherein a first arm receiving space is created from an inner surface of the outer strap, an outer surface of the inner strap, and the first divider, and wherein a second arm receiving space is created from an inner surface of the outer strap, an outer surface of the inner strap, and the second divider.

19. The baby swaddle of claim 17 wherein the first divider and second divider are attached to an outer surface of the inner strap.

20. The baby swaddle of claim 19, wherein an edge extending the length of the first divider is connected to the outer surface of the inner strap, and wherein an edge extending the length of the second divider is connected to the outer surface of the inner strap.

* * * * *